US010549820B2

(12) United States Patent
Lane et al.

(10) Patent No.: US 10,549,820 B2
(45) Date of Patent: Feb. 4, 2020

(54) METHOD AND SYSTEM FOR HEADING CONTROL DURING SHIP-TO-SHIP TRANSFER OF LNG

(71) Applicant: Excelerate Energy Limited Partnership, The Woodlands, TX (US)

(72) Inventors: Mark Kevin Lane, Key Largo, FL (US); Charles Erwin Ruehl, Jr., Humble, TX (US); Michael Todd Carroll, Katy, TX (US)

(73) Assignee: Excelerate Energy Limited Partnership, The Woodlands, TX (US)

( * ) Notice: Subject to any disclaimer, the term of this patent is extended or adjusted under 35 U.S.C. 154(b) by 0 days.

(21) Appl. No.: 16/336,454

(22) PCT Filed: Sep. 29, 2017

(86) PCT No.: PCT/US2017/054547

§ 371 (c)(1),
(2) Date: Mar. 25, 2019

(87) PCT Pub. No.: WO2018/064598

PCT Pub. Date: Apr. 5, 2018

(65) Prior Publication Data

US 2019/0233058 A1 Aug. 1, 2019

Related U.S. Application Data

(60) Provisional application No. 62/402,841, filed on Sep. 30, 2016, provisional application No. 62/423,615, filed on Nov. 17, 2016.

(51) Int. Cl.
*B63B 21/50* (2006.01)
*B63B 21/20* (2006.01)
(Continued)

(52) U.S. Cl.
CPC ..... *B63B 21/50* (2013.01); *B63B 21/00* (2013.01); *B63B 21/20* (2013.01); *B63B 27/25* (2013.01);
(Continued)

(58) Field of Classification Search
CPC ..... B63B 21/50; B63B 27/25; B63B 35/44; B63B 27/32; B63B 21/00; B63B 21/20;
(Continued)

(56) References Cited

U.S. PATENT DOCUMENTS 3,583,354 A * 6/1971 Flickinger ..... B63B 21/50 114/293
3,886,882 A * 6/1975 Thornburg ..... B63B 21/14 114/40

(Continued)

*Primary Examiner* — Anthony D Wiest
(74) *Attorney, Agent, or Firm* — Frederic Dorwart, Lawyers PLLC; Penina Michlin Chiu

(57) ABSTRACT

A method and system for heading control during ship-to-ship (STS) transfer of liquefied natural gas (LNG). A method for heading control during STS transfer of LNG while moored on a buoy includes berthing a floating storage regasification unit (FSRU) to a buoy at a forward end of the FSRU, holding a stern of the berthed FSRU at a first heading with a bow of the FSRU pointing into a current, docking an LNG carrier (LNGC) alongside the berthed FSRU, mooring the LNGC to the berthed FSRU in a double-banked configuration at the first heading, adjusting the first heading of the FSRU and moored LNGC to a second heading with the bow of the FSRU and a bow of the LNGC pointing into a swell, and transferring LNG from the LNGC to the FSRU while the FSRU and moored LNGC are pointed into the swell.

23 Claims, 10 Drawing Sheets

(51) Int. Cl.

| | |
|---|---|
| ***B63B 21/00*** | (2006.01) |
| ***B63B 27/25*** | (2006.01) |
| ***B63B 27/32*** | (2006.01) |
| ***B63B 35/44*** | (2006.01) |

(52) U.S. Cl.
CPC ..... *B63B 27/32* (2013.01); *B63B 35/44* (2013.01); *B63B 2021/009* (2013.01); *B63B 2021/203* (2013.01); *B63B 2035/448* (2013.01)

(58) Field of Classification Search
CPC ..... B63B 2021/009; B63B 2021/203; B63B 2035/448; B63B 27/34; B63B 25/16
See application file for complete search history.

(56) References Cited

U.S. PATENT DOCUMENTS

| | | | | |
|---|---|---|---|---|
| 6,216,628 | B1 | 4/2001 | Poldervaart | |
| 7,299,760 | B2 * | 11/2007 | Boatman | B63B 21/50 114/230.12 |
| 7,673,577 | B2 * | 3/2010 | Poldervaart | B63B 21/507 114/230.1 |
| 2007/0289517 | A1 | 12/2007 | Poldervaart et al. | |
| 2008/0096448 | A1 * | 4/2008 | Lokken | B63B 22/021 441/4 |
| 2016/0009352 | A1 | 1/2016 | Cooper et al. | |
| 2016/0009353 | A1 * | 1/2016 | Cooper | B63B 21/507 701/21 |

* cited by examiner

METHOD FOR HEADING CONTROL AT A TURRET BUOY

METHOD AND SYSTEM FOR HEADING CONTROL DURING SHIP-TO-SHIP TRANSFER OF LNG

BACKGROUND

1. Field of the Invention

Embodiments of the invention described herein pertain to the field of marine transport of liquefied natural gas (LNG). More particularly, but not by way of limitation, one or more embodiments of the invention enable a method and system for heading control during ship-to-ship transfer of LNG.

2. Description of the Related Art

Natural gas is often carried in liquefied form onboard special cryogenic tanker ships from the location of its origin to the location of consumption. In this way, natural gas may be efficiently transported to areas with a demand for natural gas. Since liquefied natural gas (LNG) occupies only about 1/600th of the volume that the same amount of natural gas does in its gaseous state, liquefying the natural gas for transport facilitates the transportation process and improves the economics of the system. LNG is produced in liquefaction plants by cooling natural gas below its boiling point (−259° F. at atmospheric pressure). The LNG may be stored in cryogenic containers either at or slightly above atmospheric pressure. Typically the LNG will be regasified prior to distribution to end users.

Traditionally, a vessel equipped with regasification facilities (regasification vessel) is loaded with LNG cargoes at the natural gas supply source and travels across the ocean to another location for offloading and distribution. However, in many instances, the offloading port requires a continual long term supply of natural gas, rather than intermittent supply provided by single cargoes. In such instances, a floating storage regasification unit (FSRU) may dock at the delivery port, typically at a jetty, and be replenished with LNG by means of ship-to-ship (STS) transfer from LNG carriers (LNGC) that transport LNG from a natural gas supply source. During STS transfer, the LNGC may dock alongside the FSRU, or across the jetty from the FSRU, and employ a transfer manifold of flexible hoses or articulated loading arms to transfer LNG from the cargo tanks of the LNGC to the cargo tanks of the FSRU. However, jetties are undesirable in some locations due to ambient conditions such as geography and bathymetry (e.g., water depth, ocean floor topography), wind, waves, swell, current, regulatory permitting, or infrastructure costs.

In circumstances where a jetty is not desirable, a FSRU may moor to a submerged buoy, external turret or other offshore mooring system rather than a jetty. The FSRU attaches to the mooring system at its forward end and discharges natural gas across a vaporizer and/or compressor system to an underwater pipeline through a subsea riser connected to the mooring system. A turret arrangement allows the FSRU to rotate or weathervane as may be necessary due to the resultant of external forces upon the FSRU. Due to changes in weather whilst the FSRU is moored, the vessel typically weathervanes such that its stern freely swings around the mooring system, thereby minimizing risk of damage to the FSRU due to inclement weather.

Conventionally, it has been difficult to safely and routinely conduct STS transfer operations at an offshore mooring system, such as a buoy, particularly in locations with excessive seasonal weather conditions. Seasonal changes in wind, waves, swell or current may prevent safe mooring conditions for LNGCs to moor alongside the FSRU for the purpose of transferring cargo between the LNGC and the FSRU, due to a lack of the ability to maintain the FSRU heading into the desired direction. Inability to maintain the FSRU heading undesirably increases metocean related risk of damage to the vessels. If the ships are pushed, pulled and tipped in different directions, they cannot be safely connected for the duration of a cargo transfer, which can take up to 36 hours depending on the size of the LNG cargo. The relative motions between the LNGC and FSRU, caused as a result of the external forces on the vessels, may create an unsafe condition where it becomes impossible for the two vessels to remain moored alongside each other. Safety concerns include excess vessel motions such as pitching and rolling, which may cause excess strain on mooring wires, excess sloshing of cargo within the cryogenic containment, and possible collision of the vessels. Unwanted movement of either vessel may also increase the risk to crew and equipment onboard and may raise the risk of LNG leak, spill, and ignition during STS transfer.

Another problem that arises due to a lack of heading control is LNG liquid sloshing within partially-filled cargo tanks of the LNGC during STS cargo transfer operations. If not adequately contained, the liquid sloshing may cause structural failure of the LNG cargo containment structures and create severe damage to the LNGC. FSRUs typically include reinforced cargo tanks that are designed to absorb forces generated by liquid sloshing. In contrast, LNGC cargo tanks typically do not include reinforced insulation to absorb cargo sloshing forces. Instead, the LNGC may be outfitted with cryogenic containment that is lined with 0.7 mm thick stainless steel panels that are particularly prone to break if the tanks are exposed to excessive cargo sloshing forces when they are partially full. For these purposes, LNGC cargo tanks are typically considered to be "partially full" when they are between 10% and 70% full. The risk of tank damage due to sloshing is maximized when the LNGC is positioned sideways to the ocean swell. Turning the FSRU and LNGC to head the bow of the vessels into the ocean swell decreases sloshing risk. In some locations the tidal current, as a result of lunar driven tides, changes direction over fairly short periods and may cause the FSRU and LNGC to lay across the ocean swell in an undesirable manner. The direction of tidal current frequently changes, as frequently as every six hours, and the direction of the ocean swell remains fairly constant over longer periods of time. These changes in current can be particularly dangerous during STS transfer operations that take up to 36 hours to complete, since the tidal current influence on the FSRU and LNGC is usually far greater when it comes to weathervaning the vessels. In fact, the effect of the tidal current on the vessels can be similar to the effect of wind, whereas one knot of tidal current is equal to about twenty knots of wind speed. Therefore the vessels will lay to the resultant of the forces of the wind and current such that the swell may cause the detrimental rolling of the vessels with subsequent cargo sloshing risk.

Although floating offshore production and storage units (FPSO), moored at turrets in deep waters, have been capable of transferring oil between ships, the oil transfer technology has not been applicable to LNG transfers. The FPSO mooring systems may employ heavy chains (about 600 pounds weight per link) and cables to anchor these large FPSOs in deep waters and maintain heading despite weather. In some cases a series of underwater thrusters may be used for position keeping of the FPSO above the oil well site. In contrast, FSRUs are typically unable to accommodate large lengths of chains and the equipment required to handle and store them due to constraints on space. Further LNGCs are not typically fitted with a series of underwater thrusters to allow them to overcome the forces of the wind and current.

It would be desirable for a FSRU or floating storage unit (FSU) moored at a buoy or turret to be able to receive LNG cargoes by STS transfer in locations that are subject to weather patterns that might otherwise limit the ability for the safe mooring of LNGCs alongside the FSRU. The ability to fix an optimal directional heading for the FSRU relative to the effects of weather would increase the opportunities for safe STS transfer of LNG cargoes from LNG carriers to the FSRU. In addition, the ability to adjust the heading for seasonal or fluctuating weather pattern changes would further increase the opportunities for safe STS transfers. Therefore, there is a need for a method and system for heading control during ship-to-ship transfer of LNG on a buoy, turret or other similar offshore mooring system.

SUMMARY

One or more embodiments of the invention enable a method and system for heading control during ship-to-ship (STS) transfer of liquefied natural gas (LNG) at a buoy, turret or other similar offshore mooring system.

A method and system for heading control during ship-to-ship transfer of LNG is described. An illustrative embodiment of a method for heading control during ship-to-ship (STS) transfer of liquefied natural gas (LNG) while moored on a buoy includes berthing a FSRU to a buoy at a forward end of the FSRU, holding a stern of the berthed FSRU at a first heading with a bow of the FSRU pointing into a current, docking an LNG carrier (LNGC) alongside the berthed FSRU, mooring the LNGC to the berthed FSRU in a double-banked configuration at the first heading, adjusting the first heading of the FSRU and moored LNGC to a second heading, wherein the bow of the FSRU and a bow of the LNGC are pointing into a swell at the second heading, and wherein the swell has a direction, and transferring LNG from the LNGC to the FSRU while the FSRU and moored LNGC are pointed into the swell. In some embodiments, the method further includes changing the second heading of the FSRU and moored LNGC to a third heading into a second swell having a second direction during the LNG transfer from the LNGC to the FSRU when the second swell develops and prevails in magnitude above the first swell. In certain embodiments, adjusting the first heading of the FSRU and moored LNGC includes using at least one thruster at a stern of the FSRU to adjust both the FSRU and the LNG to the second heading. In some embodiments, adjusting a heading of the FSRU and moored LNGC includes adjusting a length of at least two spread mooring lines to rotate a direction of a stern of the FSRU about the buoy, wherein the at least two spread mooring lines are coupled to the stern of the FSRU. In certain embodiments, mooring the LNG to the berthed FSRU in a double-banked configuration includes connecting the bow of the FSRU to the bow of the LNGC with a first connecting line and connecting a stern of the FSRU to a stern of the LNGC with a second connecting line. In some embodiments, the buoy is a subsea turret buoy.

An illustrative embodiment of a system for heading control during ship-to-ship (STS) transfer of liquefied natural gas (LNG) to a floating storage regasification unit (FSRU) moored at a turret buoy includes the FSRU moored in a water at the turret buoy, an LNG carrier (LNGC) moored to the FSRU in a double-banked configuration such that a bow of the LNGC and a bow of the FSRU face same direction at a first heading of a plurality of headings, the LNGC including a manifold of a plurality of hoses fluidly coupling the LNGC to the FSRU, the LNG flowing from the LNGC through at least one of the plurality of hoses to the FSRU, and at least one thruster coupled to a stern of the FSRU, wherein the at least one thruster is adjustable to turn both the FSRU and moored LNGC between the first heading and a selected heading of the plurality of headings. In some embodiments, the selected heading holds the bow of the FSRU and the bow of the LNGC against a predominant factor, wherein the predominant factor is a resultant force of wind, swell, waves and current. In certain embodiments, the first heading faces the bow of the LNGC and the bow of the FSRU into a current of the water, and the selected heading faces the bow of the LNGC and the bow of the FSRU into a swell of the water. In some embodiments, a first mooring line extends between the bow of the LNGC and the bow of the FSRU, and a second mooring line extends between the stern of the FSRU and a stern of the LNG. In certain embodiments, the turret buoy is submerged in the water, and a subsea riser fluidly couples the FSRU to a subsea gas pipeline.

An illustrative embodiment of a heading control method for ship-to-ship (STS) transfer of liquefied natural gas (LNG) while moored on a buoy includes berthing a FSRU to the buoy at a forward end of the FSRU, connecting at least two spread mooring lines to a stern of the berthed FSRU, anchoring the stern of the berthed FSRU to a seabed using the at least two spread mooring lines such that a bow of the FSRU is held against a predominant factor, calculating at intervals a resultant force of oceanic conditions and weather to determine the predominant factor at a particular time, adjusting a length of the at least two spread mooring lines to rotate a direction of the stern of the FSRU about the buoy based on the predominant factor so calculated, and transferring LNG to the moored and anchored FSRU using STS transfer from a LNG carrier. In some embodiments, there are three spread mooring lines including a port side line, a starboard side line and a center line between the port side line and the starboard side line, and adjusting the length of the at least two spread mooring lines includes one of: retracting the starboard side line and the center line and extending the port side line, or retracting the port side line and the center line and extending the starboard side line. In certain embodiments, adjusting the length of one of the at least two spread mooring lines includes using a storm line assembly to prepare for severe weather. In some embodiments, the direction of the stern of the FSRU rotates between 10 degrees and 60 degrees about the buoy during adjustment. In certain embodiments, adjusting the length of the at least two spread mooring lines moderates sloshing of LNG cargo tanks of the LNG carrier. In some embodiments, adjusting the length of the at least two spread mooring lines moderates motion of the FSRU and the LNG carrier.

An illustrative embodiment of a heading control system for ship-to-ship (STS) transfer of liquefied natural gas (LNG) to a floating unit moored at a turret buoy includes the floating unit moored in a water at the turret buoy, an LNG carrier (LNGC) moored to the floating unit in a double-banked configuration such that a bow of the LNGC and a bow of the floating unit face same direction at a first heading of a plurality of headings, the LNGC including a manifold of a plurality of hoses fluidly coupling the LNGC to the floating unit, the LNG flowing from the LNGC through at least one of the plurality of hoses to the floating unit, and at least two stern heading control lines anchoring a stern of the floating unit to a seabed, each of the stern heading control lines including a winch, a guide, a line locking system and a release coupling, and wherein the at least two stern heading control lines are adjustable to turn both the floating unit and moored LNGC between the first heading and a selected heading of the plurality of headings. In some embodiments, the selected heading holds the floating unit and the LNGC against a predominant factor, where the predominant factor is a resultant force acting upon the floating unit. In certain embodiments, the forces acting upon the floating unit are one of wind, waves, swell, current, or a combination thereof. In some embodiments, the first heading is against a current and the predominant factor is swell. In certain embodiments, there are more than two stern mooring lines. In some embodiments, the floating unit is a floating storage unit (FSU). In certain embodiments, the buoy is a turret external to the floating unit. In some embodiments, the floating unit is a floating storage regasification unit (FSRU).

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
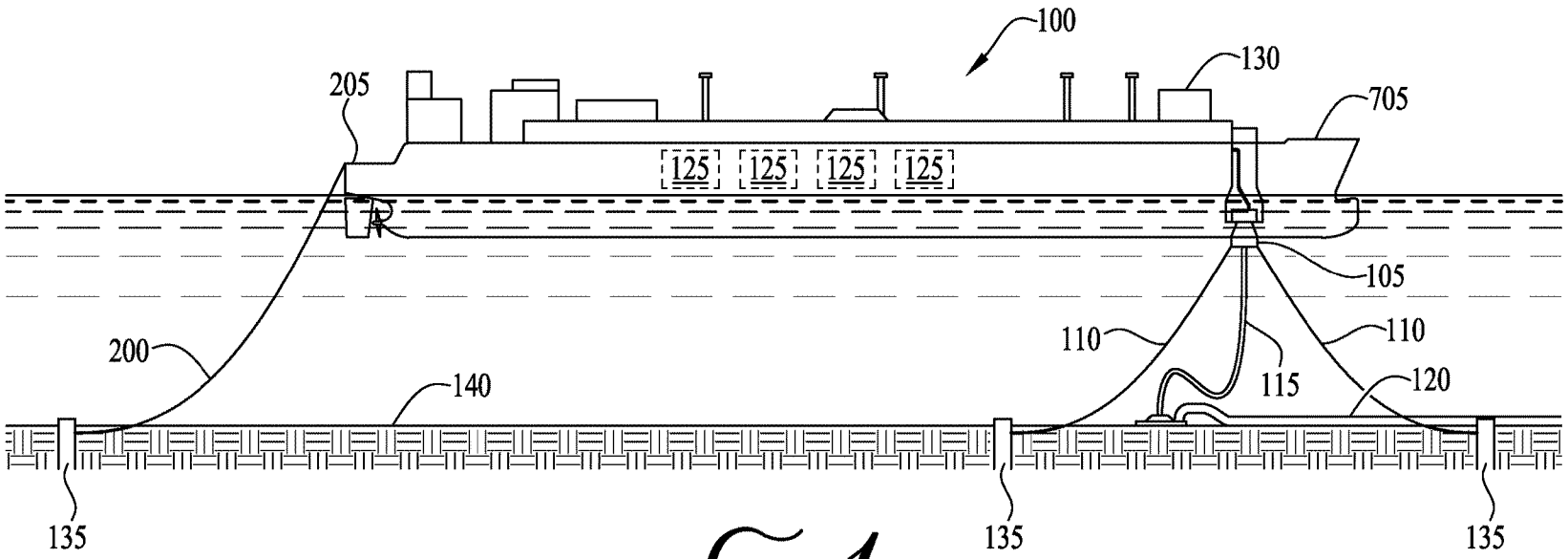
FIG. 1 is a side elevation view of a heading control system of an illustrative embodiment having an exemplary subsea turret buoy.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

A method and system for heading control during ship-to-ship (STS) transfer of liquefied natural gas (LNG) is described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a mooring line includes one or more mooring lines.

As used in this specification and the appended claims, "coupled" refers to either a direct connection or an indirect connection (e.g., at least one intervening connection) between one or more objects or components. The phrase "directly attached" means a direct connection between objects or components.

As used in this specification and the appended claims, "FSRU" refers to a floating storage and regasification unit. A FSRU is a floating structure with LNG regasification facilities onboard, and the ability to both receive LNG cargo as a liquid and discharge such cargo as a gas. For ease of description and so as not to obscure the invention, illustrative embodiments are primarily described herein with respect to an FSRU. However, the invention is equally applicable to other LNG or gaseous natural gas transport, storage and/or regasification vessels that may be moored offshore at a submerged turret, external turret, single point mooring buoy, or other offshore mooring system used by a floating storage unit (FSU), regasification vessel or LNG carrier.

As used in this specification and the appended claims, "LNGC" refers to a liquefied natural gas carrier. A LNGC is a ship capable of loading, transporting, storing and discharging LNG.

As used in this specification and the appended claims, a "line" may be any combination of chain, fiber line and/or wire rope.

As used in this specification and the appended claims, "heading control" means a temporary or semi-permanent restriction on the weathervane feature of an offshore mooring system, and includes the ability to maintain the vessel heading into the desired direction.

In the art, "metocean" refers to the syllabic abbreviation of meteorology and physical oceanography.

Illustrative embodiments provide a method and system for controlling the heading of a FSRU moored at a buoy, including a FSRU receiving LNG cargoes using STS transfer while the FSRU is moored to the buoy. Illustrative embodiments utilize thrusters, adjustable spread mooring and/or positioning lines at the stern of the FSRU to adjust the direction of the bow of the FSRU around the buoy. The direction of the FSRU may be adjusted in response to seasonal, harmonic and/or intermittent weather changes, such as wind, waves, swell and/or current.

Illustrative embodiments provide a method and system for controlling and/or changing the heading of an FSRU delivering natural gas cargo and/or an FSRU and a double-banked LNGC while the FSRU and LNGC are in the process of conducting STS transfer operations. The FSRU may initially be pointed into the current. The LNGC may then be maneuvered and moored to the FSRU while the FSRU is pointed into the current. Once the ships are moored together and/or after STS transfer operations have commenced, the heading of both the FSRU and LNGC may together be turned into the swell. The heading of both vessels may be readjusted as needed based on the predominant factor, such as swell, in order to minimize the risk of unwanted movement of the vessels, which may allow safe STS transfer between the vessels and minimize damage due to liquid sloshing forces inside the cargo tanks. The predominant factor may be the resultant force on the FSRU of oceanic conditions and weather systems, such as wind, swell, waves and/or current. The heading of the double-banked vessels may be adjusted as needed during STS transfer operations and/or natural gas delivery.

In spread mooring line embodiments, the heading control mooring lines may include chain, fiber line and/or wire rope. The mooring lines may be adjusted by retracting (shortening) some of the mooring lines and extending (lengthening) other of the mooring lines. In one example, three spread mooring lines may be employed, spaced at intervals on the stern of the FSRU. In this example, the starboard and center lines may be shortened, and the port line may be lengthened to achieve a first heading of the FSRU. A second heading of the FSRU may be achieved from the first heading by subsequently retracting the port line and extending the starboard line. Adjustment of the lines in reverse may equally be employed. The heading control mooring lines of illustrative embodiments may include release couplings that release the mooring lines safely in the event of an emergency that requires the FSRU to disconnect from the mooring arrangement. If disconnected, a quick release system may permit the disconnected mooring lines to be retrieved at another time such as when the FSRU returns to the mooring area. A storm line may be included on one or more of the mooring lines of illustrative embodiments to provide additional length during storm conditions that are not as severe as to require disconnection from the buoy and departure. Where the FSRU and LNGC are moored together during adjustment of the mooring lines, the LNGC may rotate with the FSRU in a double-banked (e.g. side-by-side) configuration.

In some embodiments thrusters on the stern of the FSRU may adjust and/or retain the heading of the FSRU. The FSRU may be oriented into a heading and/or retain its heading by adjusting the magnitude and/or direction of thrust. The thrusters may allow for micro-adjustments and/or faster heading adjustment than mooring lines and/or mooring lines alone, and may be particularly useful where ambient conditions are frequently changing.

Illustrative embodiments may increase the operability of a FSRU for STS transfers at a buoy and increase volume delivered to an LNG delivery facility, particularly in locations subject to seasonal, harmonic and/or intermittent weather changes. Illustrative embodiments may provide an adjustable fixed (non-weathervaning) heading control system that may increase the availability for STS transfer, thereby increasing commercial value of the facility. Illustrative embodiments may reduce unwanted vessel movement as a result of oceanic and/or metocean conditions, thereby improving the safety and reliability of the STS transfer. Illustrative embodiments may provide a heading control system for STS transfers that may reduce sloshing in the tanks, thereby reducing the possibility of damage to LNG cargo tanks onboard the LNGC. Illustrative embodiments may provide heading control that allows for safety optimization during the STS transfer. Illustrative embodiments may allow both the FSRU and LNGC to adjust and/or retain headings that minimize unwanted movement of the vessels, which might otherwise pose a hazard to crew and/or equipment onboard. Illustrative embodiments may reduce the risk of collision and prevent LNG leaks, spills, and/or ignitions during STS transfer. In the event of an emergency disconnection, illustrative embodiments may allow for quick release and retrieval of the adjustable mooring lines subsequent to an emergency release event.

For ease of description and so as not to obscure the invention, illustrative embodiments are primarily described in terms of a FSRU moored at a submerged turret buoy in the sea. However, the invention is not so limited and may be equally employed, for example, to a regasification vessel moored at an external turret or to an FSU moored at another similar offshore mooring system in a lake, river or other navigable body of water.

Figure 2:
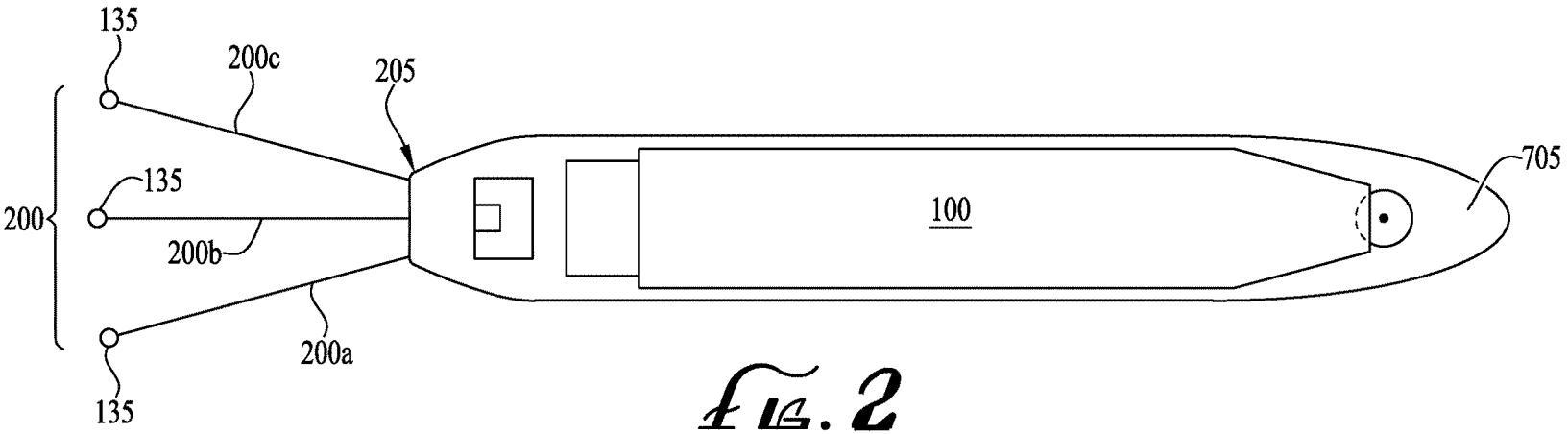
FIG. 2 is a plan view of a heading control system of an illustrative embodiment.
Figure 3:
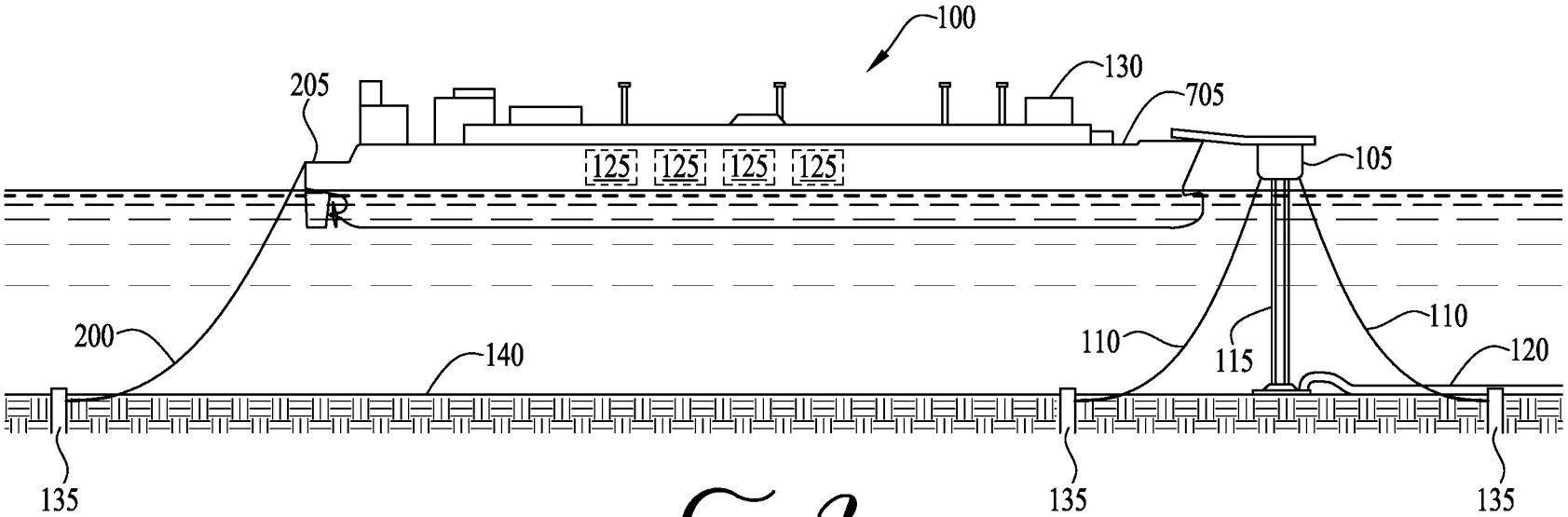
FIG. 3 is a side elevation view of a heading control system of an illustrative embodiment having an exemplary external turret buoy mooring.

FIG. 1, FIG. 2 and FIG. 3 illustrate heading control systems of illustrative embodiments. FSRU 100 may be berthed, docked and/or moored at buoy 105 in a navigable body of water such as the ocean, a lake or river. Buoy 105 may be a subsea turret buoy, as shown in FIG. 1, or an external turret buoy, as shown in FIG. 3. One or more anchor lines 110 may secure buoy 105 to seabed 140 with anchors 135. Riser 115, which may be a submerged flexible riser, steel catenary riser, steel export riser and/or umbilical may extend from buoy 105 to seabed 140 and may connect buoy 105 to subsea natural gas pipeline 120 that may be coupled to gas distribution lines and/or other facilities to provide natural gas to end users. FSRU 100 may berth to buoy 105 at and/or proximate the forward end and/or bow of FSRU 100. FSRU 100 may be a mobile floating storage regasification unit, a regasification vessel, and/or another floating vessel or platform with LNG regasification facilities 130 onboard, and the ability to both receive LNG cargo as a liquid and discharge such cargo as a gas. Suitable regasification facilities 130 and LNG ship-to-ship transfer equipment may be as described in WO 2010/120908 to Bryngelson et al., which is commonly owned. In some embodiments, FSRU 100 may be an FSU or LNGC that stores LNG but does not include regasification capabilities. In such instances the FSU or LNGC, moored at buoy 105, may serve as a floating LNG supply station. FSRU 100 may store LNG in LNG cargo tanks 125 in the hull of the FSRU 100.

Turning to FIG. 2, at least two heading control lines (spread mooring lines) 200 may lead off stern 205 of FSRU 100. Heading control lines 200 may be spread mooring lines secured by anchor 135 and employed to adjust and/or secure the heading of FSRU 100 and/or prevent FSRU 100 from weathervaning. Three heading control lines 200 are shown in FIG. 2, including starboard line 200*a*, center line 200*b* and port line 200*c*. Heading control lines 200 may be spread moored, as shown in FIG. 2. Heading control lines 200 may secure FSRU 100 at a selected heading and may be adjustable in order to position FSRU 100 relative to prevailing seasonal weather patterns, while providing safe mooring for LNGCs 800 (shown in FIG. 8A) moored alongside FSRU 100 during LNG cargo transfer. Heading control lines 200 may be made of anchor chain, wire rope and/or fiber line, for example ultra-high molecular weight polyethylene. Sections of heading control lines 200 including anchor chain may be minimized to reduce the weight of heading control lines 200. Heading control lines 200 may connect on a first end to stern 205 and on a second end to seabed 140, for example by anchor 135.

Figure 4:
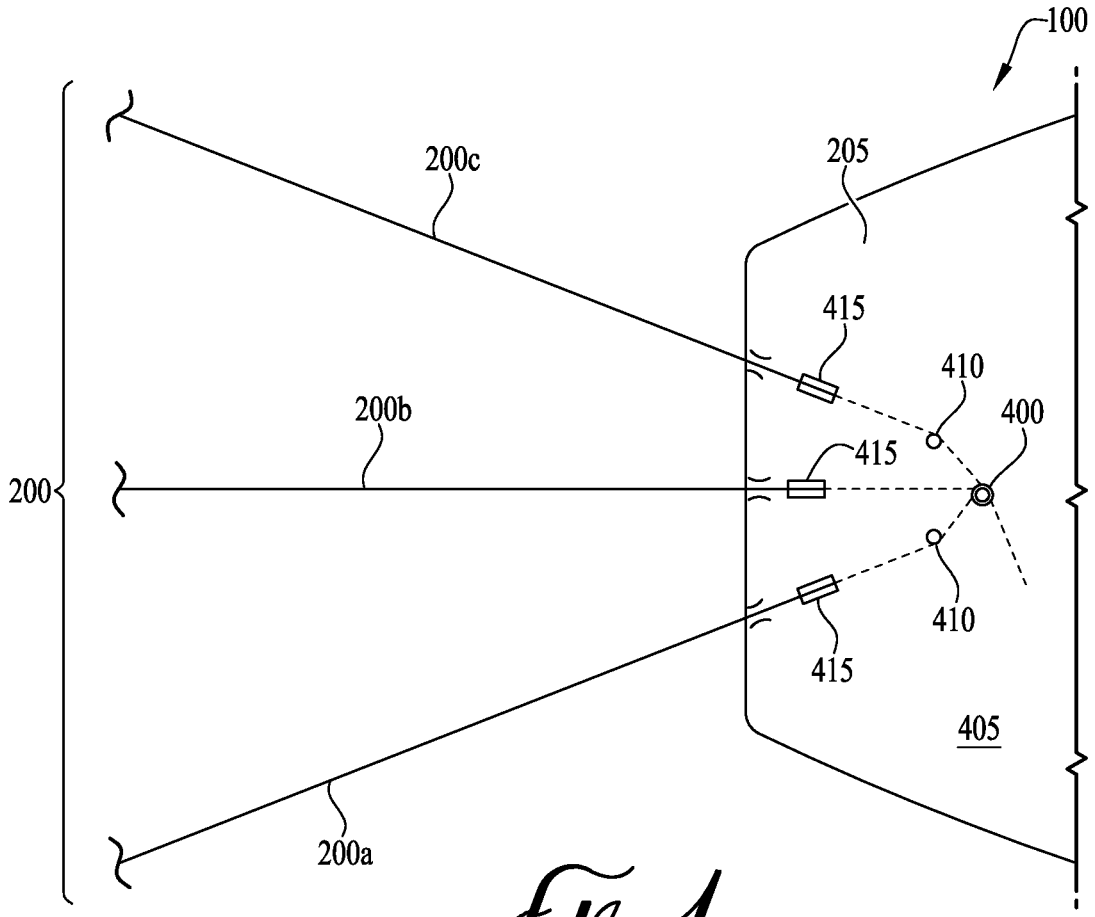
FIG. 4 is a plan view of adjustable heading control lines of an illustrative embodiment.
Figure 5:
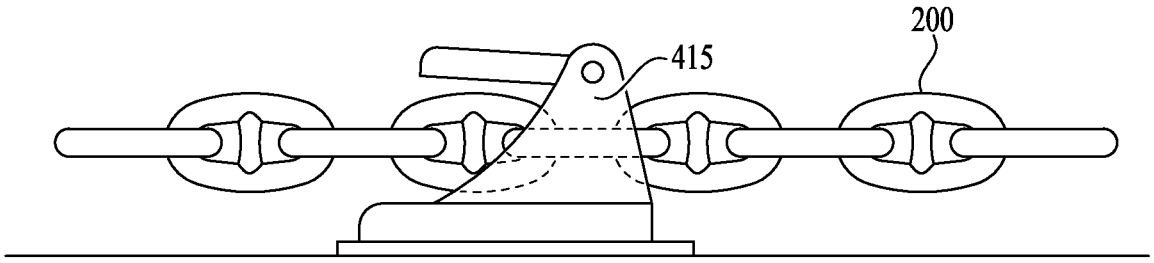
FIG. 5 is a side elevation view of a quick release coupling of an illustrative embodiment.

FIG. 4 illustrates heading control lines 200 at the connection of heading control lines 200 to stern 205 of FSRU 100. One or more winches 400, which may be winches, single drums or split drums, may secure heading control lines 200 to deck 405 of stern 205. Winch 400 may be rotatable and turned by a motor or another power source in order to extend (lengthen) or retract (shorten) one or more heading control lines 200 by winding or unwinding portions of heading control lines 200 around winch 400. Guides 410 may adjust, control and/or secure the angle between heading control lines 200, so as to separate heading control lines 200 from one another and provide a spread mooring arrangement. Each heading control line 200 may include quick and/or emergency release coupling 415, which may allow heading control lines 200 to promptly disconnect in the event of severe weather or other emergency such as a cyclone or fire. FIG. 5 shows a release coupling of an illustrative embodiment. Release coupling 415 may be a quick release coupling and/or an emergency release coupling (ERC) and may trap disconnected chains and/or lines so as to prevent them from falling into the water. Upon activation of release coupling 415, heading control lines 200 may disconnect from stern 205 and/or anchor 135.

Figure 6:
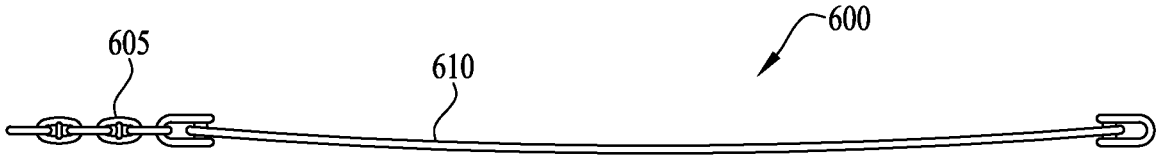
FIG. 6 is a side elevation view of a storm line of an illustrative embodiment.

FIG. 6 illustrates a storm line assembly 600 that may include a section of anchor chain 605, fiber line 610, and/or wire rope. Storm line assembly 600 may be connected to one or more select heading control lines 200 to increase adjustable line length in preparation for storms, the severity of which are moderate enough that disconnection and/or release of heading control lines 200 is not necessary.

A selected heading of FSRU 100 may be achieved using thrusters 1000 (shown in FIG. 10) and/or by extending and/or retracting one or more of center line 200*b*, starboard line 200*a*, port line 200*c* and/or other heading control lines 200 that may be employed to control the heading of FSRU 100 at stern 205. The heading of FSRU 100 may be adjusted as needed using a computer and/or manual calculating system to sense, predict and/or calculate a predominant factor and the corresponding desired heading. The predominant factor and/or desired heading may be determined by use of weather buoy collection of metocean data and then performing statistical data analyses to determine wave heights and periods, extreme return periods for wind, and current directions and periods. This data may then be used to perform numerical simulations to determine the range and maximum availability of STS transfer. LNGC cargo tank 840 (shown in FIG. 8A) and/or FSRU 100 cargo tank 125 membrane sloshing limitations as well as the integrity of LNGC 800 (shown in FIG. 8A) and/or FSRU 100 structure due to sloshing loads may also be factored into the predominant factor and/or heading calculations.

Figure 7A:
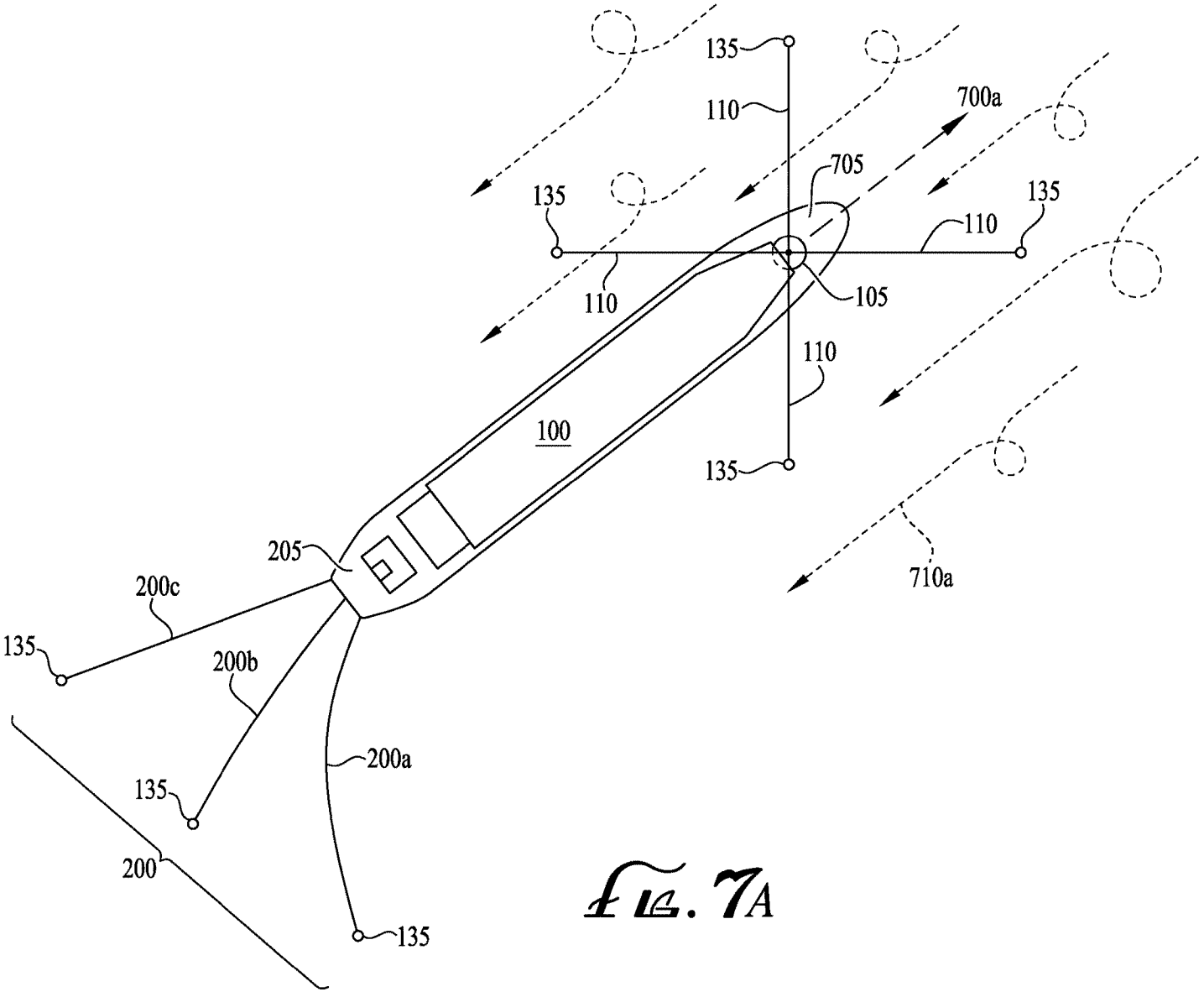
FIG. 7A is a plan view of a heading control system of an illustrative embodiment utilizing adjustable mooring lines of an illustrative embodiment to head a bow of an exemplary floating storage regasification unit (FSRU) into an exemplary predominant factor at a first heading.
Figure 7B:
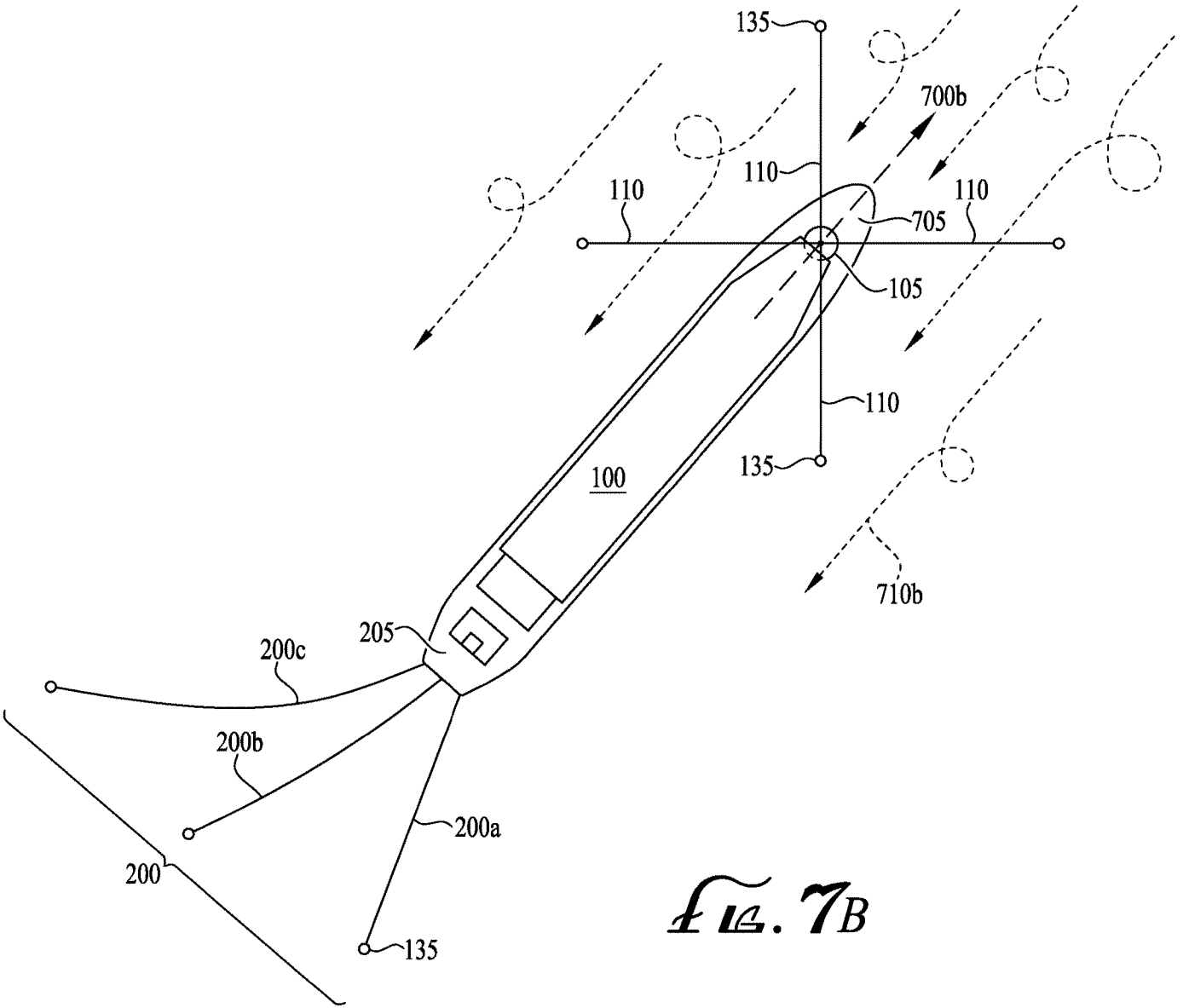
FIG. 7B is a plan view of a heading control system of an illustrative embodiment utilizing adjustable mooring lines of an illustrative embodiment to adjust the first heading of FIG. 7A to a second heading based on an exemplary change in the predominant factor.

FIG. 7A and FIG. 7B illustrate a heading control system of FSRU 100 berthed on a buoy in shallow waters. The heading of FSRU 100 may be controlled using illustrative embodiments prior to gas delivery, during natural gas delivery to pipeline 120 and/or during STS transfers between FSRU 100 and a double-banked LNGC 800. In FIG. 7A and FIG. 7B, FSRU 100 is berthed at buoy 105, which buoy 105 is secured to seabed 140 by one or more anchor lines 110. A plurality of heading control lines 200 may lead off stern 205 of FSRU 100. As shown in FIG. 7A, starboard line 200*a* is extended (lengthened), and center line 200*b* and port line 200*c* are retracted (shortened). As shown, heading control lines 200 secure FSRU 100 at a first heading 700*a*. First heading 700*a* be determined based on predominant factor 710*a*, which may be wind, waves, current, swell or other oceanic conditions and/or weather systems and/or may be the resulting force of one or more of such factors on FSRU 100. First heading 700*a* may point bow 705 of FSRU 100 into or away from predominant factor 710*a* to place FSRU 100 in the most favorable heading. In the example shown in FIG. 7A, bow 705 of FSRU 100 is headed into predominant factor 710*a*. By way of example and without limitation, waves may be a predominant factor if they are causing the ship to rock and/or sloshing in the tanks. In such an instance, heading 700*a* may be selected to minimize sloshing. In another example, strong winds may be present and heading 700*a* may be selected to face bow 705 of FSRU 100 into (against) the wind.

FIG. 7B illustrates FSRU 100 having been adjusted to a second selected heading 700*b* using the method of illustrative embodiments. In FIG. 7B, the heading of FSRU 100 has been changed from first heading 700*a* to second heading 700*b*, based on a change in predominant factor 710*a* to a new predominant factor 710*b*. Second predominant factor 710*b* may be a different factor and/or a different direction than first predominant factor 710*a*. For example, first predominant factor 710*a* may be current, and second predominant factor 710*b* may be swell. In another example, both predominant factors 710*a* and 710*b* may be current, but the direction and/or magnitude of the current may change. Predominant factor 710*a*, 710*b* may represent the resultant force on FSRU 100 from wind, current, swell, waves and/or other similar factors. As shown in FIG. 7B, port line 200*c* has been extended and starboard line 200*a* has been retracted from the position of FIG. 7A, to adjust the heading of FSRU 100 to second heading 700*b*. Headings 700*a*, 700*b* may point bow 705 in any direction needed to obtain the desired headings and/or heading control, so long as, in mooring line 200 embodiments, there is sufficient length in heading control mooring lines 200. In some embodiments, heading 700*b* may be between 0° and 90° from heading 700*a* and/or heading 700*b* may be rotated about 30° from heading 700*a* either clockwise or counterclockwise. Heading of FSRU 100 may be adjusted in the instance of seasonal, harmonic or other changes in weather (wind, waves, swell and/or current) and/or a predominant factor.

Controlling and/or adjusting the heading of FSRU 100 as described herein, may permit safe STS transfer of LNG to FSRU 100 while reducing the risk of damage to LNGC 800 (shown in FIG. 8) that may otherwise be incurred due to sloshing. Illustrative embodiments improve over a weather-vaning FSRU at buoy 105. Although in some instances weathervaning may be suitable for a FSRU 100 delivering natural gas cargo, it may not be suitably safe for conducting STS transfers at buoy 105 in locations where weather may change and/or be unpredictable.

Figure 8A:
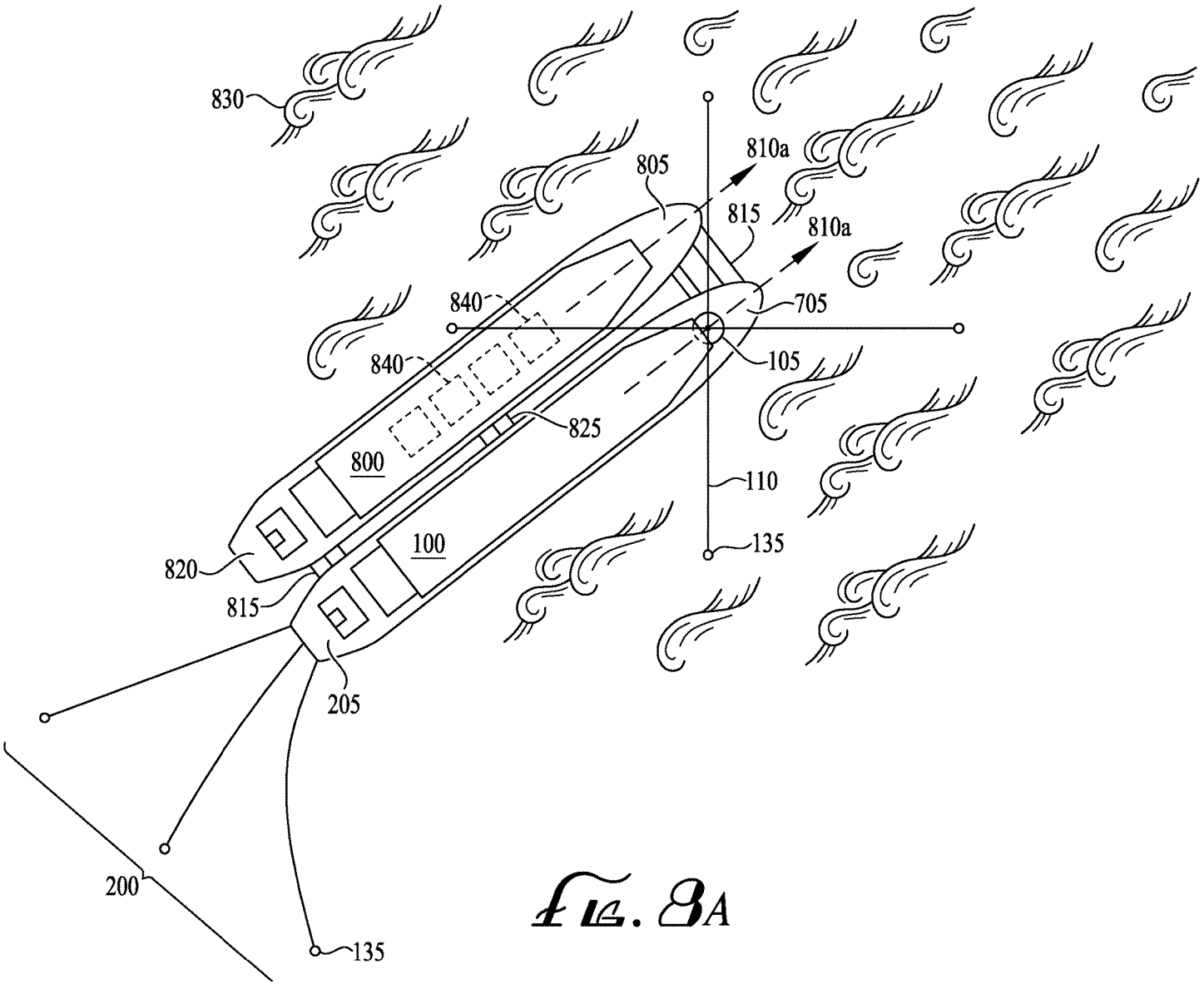
FIG. 8A is a plan view of a heading control system of an illustrative embodiment during an exemplary ship-to-ship (STS) transfer operation with an exemplary FSRU and double-banked LNG carrier (LNGC) both headed into the current at a first heading.
Figure 8B:
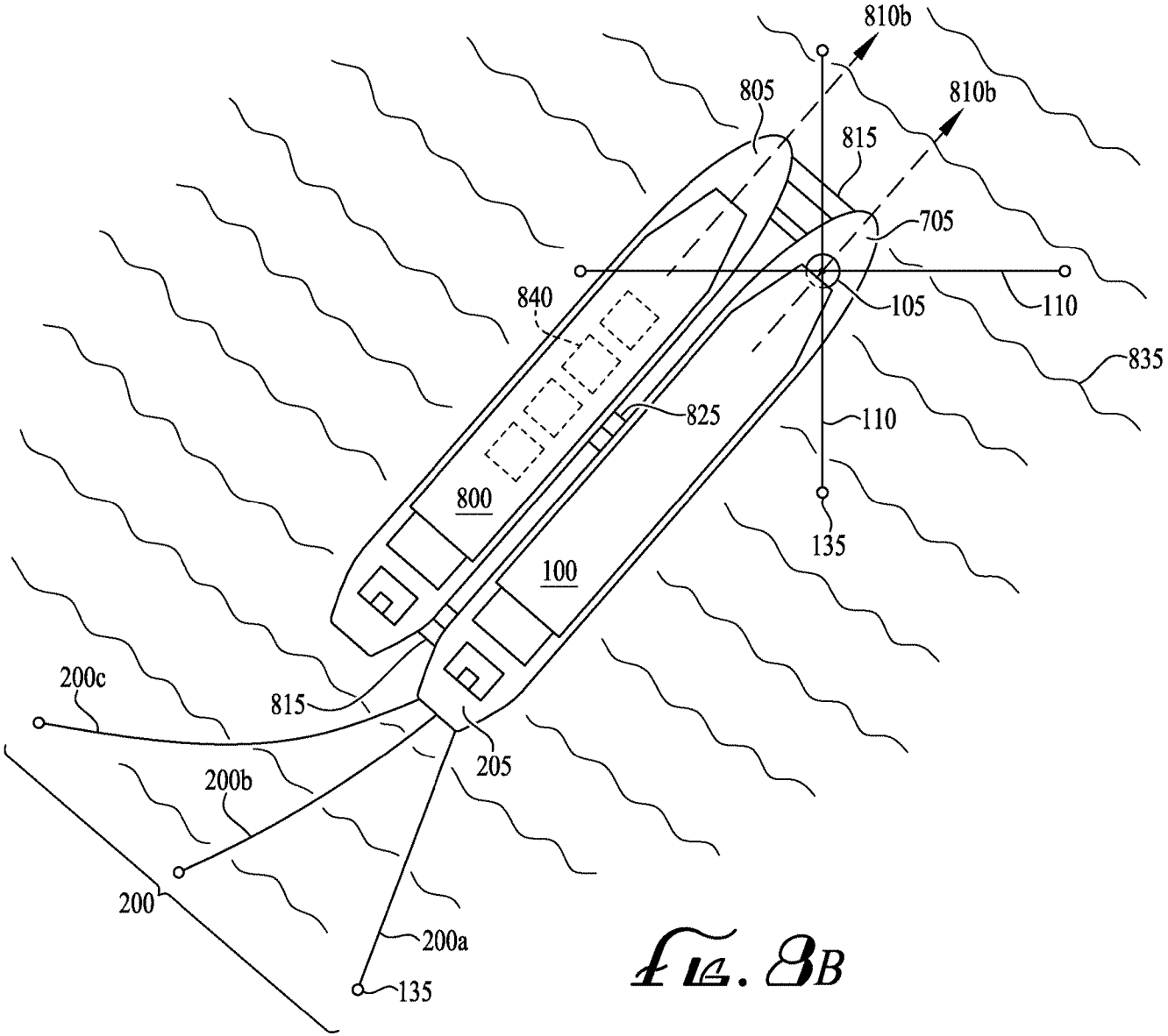
FIG. 8B is a plan view of a heading control system of an illustrative embodiment during the exemplary STS operation of FIG. 8A with the exemplary FSRU and double-banked LNGC both headed into the swell at a second heading.

FIG. 8A and FIG. 8B illustrate heading control during an STS transfer of LNG using the systems and methods of illustrative embodiments. As shown in FIG. 8A, FSRU 100 is berthed at buoy 105, and secured by heading control lines 200 at first STS heading 810*a*. FSRU 100 and LNGC 800 may be moored together side-by-side (double banked) and/or may be arranged with bow 705 of FSRU 100 facing stern 820 of LNGC 800. A side-by-side, double-banked arrangement is shown in FIG. 8A, with banking and/or connection lines 815 connecting FSRU bow 705 to LNGC bow 805, and connection lines 815 banking FSRU stern 205 to LNGC stern 820. Connection lines 815 may hold LNGC 800 at the same first STS heading 810*a* as FSRU 100. A transfer manifold 825 of gas and cryogenic liquid flexible or rigid hoses may extend between FSRU 100 and LNGC 800 to transfer LNG from the cargo tanks 840 of LNGC 800 to the cargo tanks 125 of FSRU 100. In this manner, LNGC 800 and FSRU 100 may be held at the most favorable STS heading 810*a* with respect to a predominant factor such as wind, waves, swell, current or other weather. As shown in FIG. 8A, STS first heading 810*a* heads the bow 705 of FSRU 100 and the bow 805 of LNGC 800 into current 830. Heading FSRU 100 and LNGC 800 into current 830 may be the optimal direction of first STS heading 810*a* while LNGC 800 is docked alongside FSRU 100 and LNGC 800 is moored and/or double-banked to FSRU 100.

Once LNGC 800 and FSRU 100 are moored together, the heading of both FSRU 100 and LNGC 800 may be changed from first STS heading 810*a* to a selected second STS heading 810*b*, as shown in FIG. 8B. Heading 810*b* may be different from first STS heading 810*a* based on the resultant force acting on FSRU 100 and/or STS heading 810*b* may head both FSRU 100 and LNGC 800 into swell 835. Turning the bows 705, 805 of both LNGC 800 and FSRU 100 into swell 835 may minimize sloshing in the LNGC cargo tanks 840 and/or FSRU cargo tanks 125 during STS transfer operations where LNG is transferred from LNGC 800 and/or LNGC cargo tanks 840 to FSRU 100 and/or cargo tanks 125 of FSRU 100. Selected STS heading 810*b* may provide a safe environment for the transfer of LNG between the LNGC 800 and FSRU 100, allowing FSRU 100 to provide a continuous supply of LNG to the gas distribution pipelines 120 without FSRU 100 having to leave buoy 105 to replenish LNG cargo. During STS transfer operations, both LNGC 800 and FSRU 100 may be held and/or adjusted to be against swell 835 and/or with or against a predominant factor as appropriate using heading control lines 200 and/or thrusters 1000 (shown in FIG. 10) of illustrative embodiments. If during LNG transfer from LNGC 800 to FSRU 100 a subsequent swell 835 develops and prevails in magnitude above the first swell 835, the heading of the FSRU 100 and LNGC 800 may be modified to keep the FSRU 100 and LNGC 800 heading into the swell during the duration of STS transfer operations despite changes in magnitude or direction of swell 835.

Figure 10:
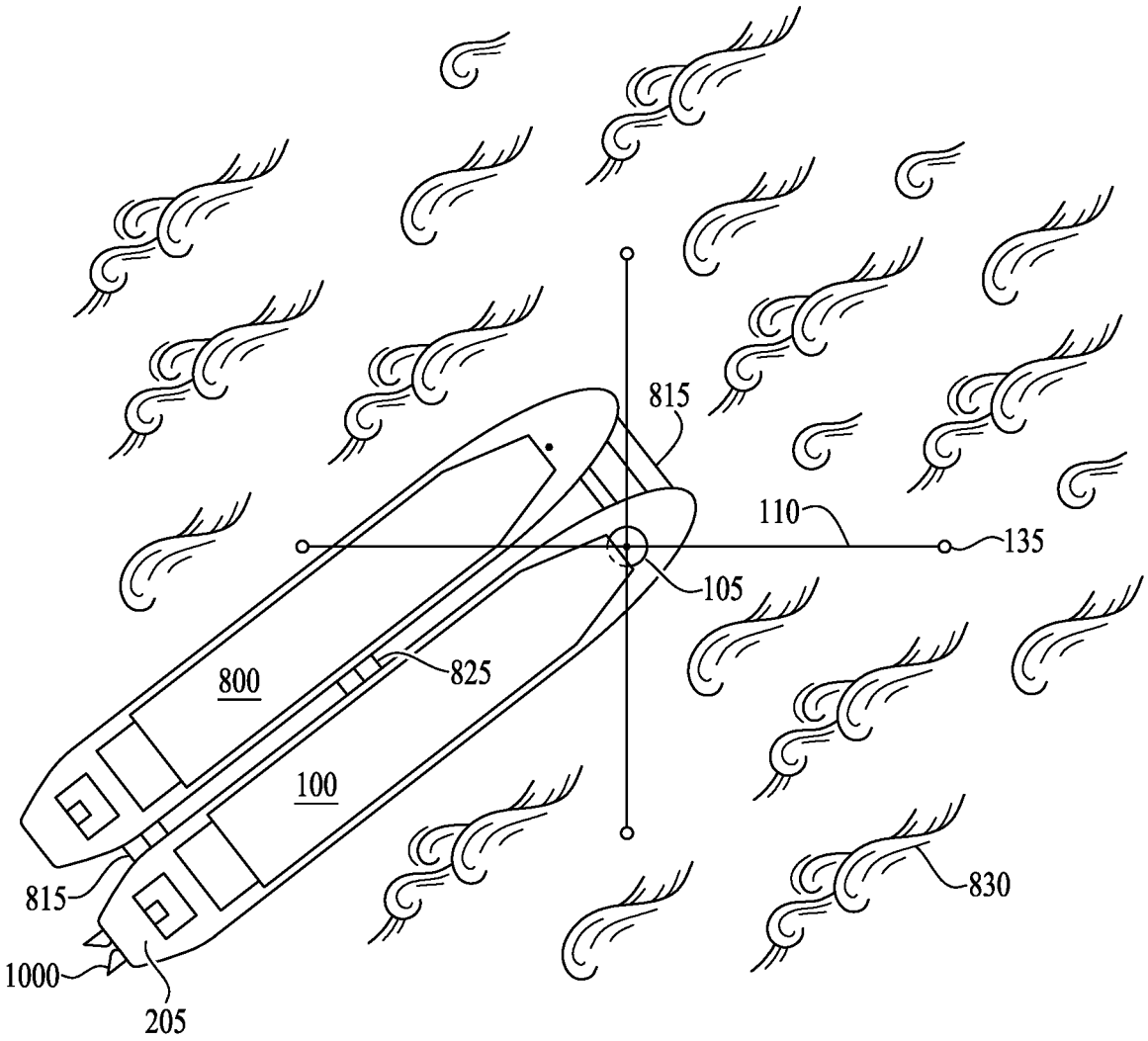
FIG. 10 is a plan view of a ship-to-ship transfer operation having a thruster type heading control system of an illustrative embodiment.

Turning to FIG. 10, illustrative embodiments may include one or more thrusters 1000, which may allow for heading control of FSRU 100 and/or a coupled LNGC 800 rather than, or in addition to, heading control lines 200. Thrusters 1000 may also allow FSRU 100 and/or attached LNGC 800, to expediently adjust heading, before or after the vessels have been moored together and/or STS operations have commenced. As shown in FIG. 10, one or more thrusters 1000 may be on and/or proximate stern 205 of FSRU 100, which may allow FSRU 100, and/or connected LNGC 800, to pivot about buoy 105 by adjusting the direction and/or magnitude of the force induced by thruster 1000. One or more thrusters 1000 may be fully or partially submerged when coupled to stern 205 of FSRU 100 such that movement may be induced by propelling the surrounding water in a particular direction and/or with a particular magnitude using thrusters 1000. The size, power, number and location of thrusters 1000 on FSRU 100 may be determined based on vessel size, environmental conditions, and/or ocean conditions. The thrusters of illustrative embodiments may be retractable, rotatable, or fixed and may be azimuth thrusters, tunnel thrusters, propeller-type thrusters, rim-driven thrusters, and/or water jets. In some embodiments, a tug may be employed for heading adjustment of FSRU 100 rather than or in addition to thrusters 1000 and/or heading control lines 200.

Figure 9:
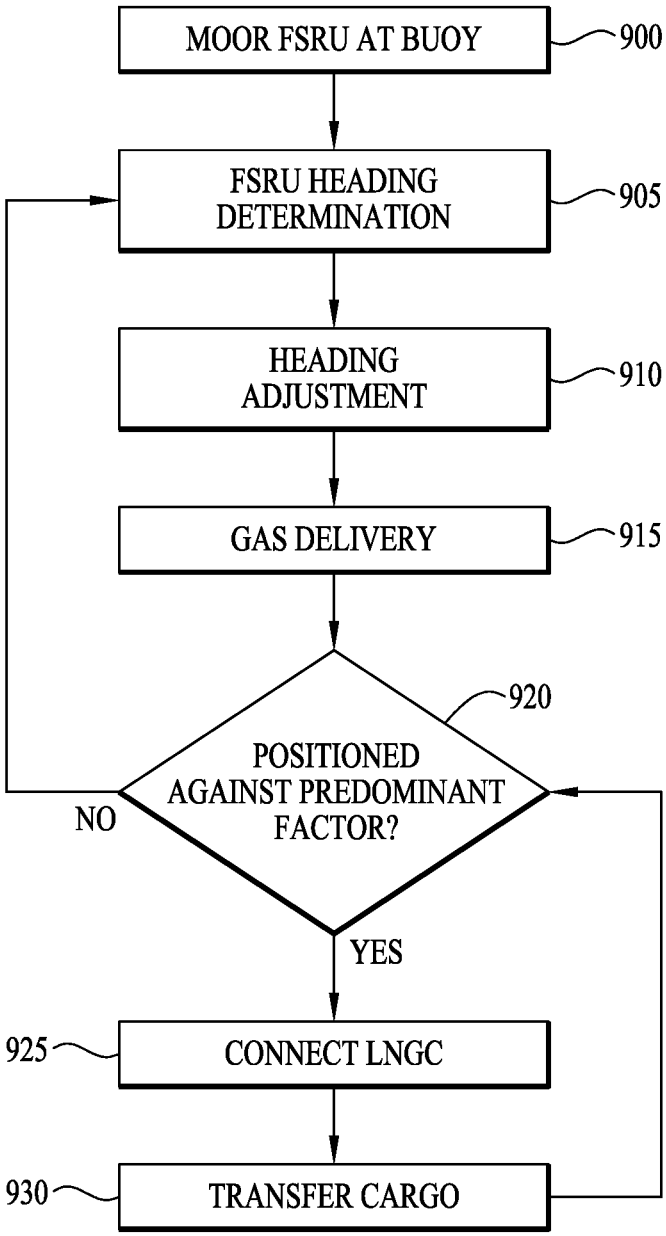
FIG. 9 is a flowchart diagram of a method of heading control of an illustrative embodiment during natural gas delivery at a buoy.

FIG. 9 illustrates a flowchart of a method of an illustrative embodiment for controlling a heading of FSRU 100 while moored at a turret buoy 105 and delivering natural gas cargo. The method of illustrative embodiments may permit the heading of FSRU 100 to be adjusted while moored at turret buoy 105 to accommodate changes in wind, waves, current, weather and/or other metocean conditions. At mooring step 900, bow 705 of FSRU 100 may be moored at buoy 105. At heading determination step 905, the safest heading for FSRU 100 may be calculated and/or determined. For example, the heading may be selected to hold FSRU 100 against predominant factor 710*a*. As step 910, at least two heading control lines 200 may be secured off of stern 205 of FSRU 100, and anchored to hold the desired position of stern 205. The length of one or more heading control lines 200 may be adjusted to cause FSRU 100 to face the desired heading, such as heading 700*a*, while FSRU 100 is held against wave, wind, and/or current metocean conditions. In some embodiments, thrusters 1000 and/or a tug may be used to hold the desired position of stern 205. LNG may then be regasified and delivered as natural gas by FSRU 100 through buoy 105 and submerged pipeline 120 at delivery step 915.

Wind, waves, current and/or swell may be monitored, and if at monitoring step 920 FSRU 100 continues to head in a safe direction to minimize the negative effects of wind, waves and/or current (such as sloshing), then LNGC 800 may be connected to FSRU 100 at connecting step 925. In some embodiments, at monitoring step 920 it may be determined whether FSRU 100 is headed into the current before LNGC 800 may be moored alongside FSRU 100. LNGC 800 may be moored to FSRU 100 at the same heading as FSRU 100 using connecting lines 205. LNG may be transferred from the cargo tanks 840 of LNGC 800 to the cargo tanks 125 of FSRU 100 using side-by-side STS transfer, using manifold 825 of gas and/or liquid saddles and hoses at transfer step 930. In some embodiments, bow to stern mooring may be employed rather than side-by-side STS transfer. If on the other hand, at step 920, FSRU 100 is not headed in a safe or favorable direction and/or FSRU 100 is not facing into the current, then a new heading determination may be made by returning to heading determination step 905. Thrusters 1000 and/or heading control lines 200 may then be adjusted to turn FSRU 100 to the new heading.

As described herein, the heading of FSRU 100 may be adjusted by rotating the FSRU about buoy 105. The desired heading may be accomplished by a combination of extension and/or retraction of two or more heading control lines 200, and/or adjustment of the angles of heading control lines 200 using guides 10, and may allow FSRU 100 to rotate in any desired direction, such as between 10° and 60° from the starting position. In one example, retraction of center line 200*b* and starboard line 200*a*, along with the extension of port line 200*c*, may result in FSRU 100 swiveling about connected buoy 105 and an adjustment of the heading of FSRU 100. The retraction and/or extension of the heading control lines 200 may be conducted with various permutations and magnitudes in order to achieve a given heading of FSRU 100, which may be determined at heading determination step 905. In some embodiments, the desired heading may be accomplished by changing the magnitude of force and/or direction of thrusters 1000.

Swiveling FSRU 100 about buoy 105 in order to adjust the heading orientation of the vessels may be accomplished using thrusters 1000 or a tug in addition to, or instead of, heading control lines 200. The desired heading may be attained by swiveling, triggering, and/or otherwise adjusting thrusters 1000 connected to stern 205 of FSRU 100, as described herein. In one example, a single thruster 1000 may be rotated to provide thrust in one direction in order to swivel FSRU 100 in the direction opposite the applied thrust. In another example, two thrusters 1000 pointed in opposing directions may be alternated between on and off. In some embodiments, a tug boat connected to FSRU 100 by a line may rotate FSRU 100 about buoy 105. The direction and/or magnitude of thrust provided by thrusters 1000 attached to FSRU 100 may be adjusted continuously or regularly by an operator and/or computer control system in order to accommodate changing ocean and weather conditions, for example to minimize the effects of sloshing and/or otherwise optimize the safety of the STS transfer operation.

If the predominant factor changes, thrusters 1000 may be rotated, undergo magnitude adjustment, and/or alternate between an on and off position in order to adjust the heading of FSRU 100 and/or LNGC 800 to the safest and/or desired direction. During STS transfer of LNG between LNGC 800 and FSRU 100 and/or natural gas delivery, an operator and/or computer system may detect, monitor and/or predict weather and wave conditions in order to identify a risk of sloshing or other damage. The identification of these conditions may be followed by adjustments to thrusters 1000 and/or heading control lines 200 in order to accommodate these changing conditions and minimize the risk of sloshing-induced damage to FSRU 100 and/or LNGC 800. In other illustrative embodiments, a computer control system may continuously or regularly calculate such operating and met-ocean conditions and adjust thrusters' 1000 direction and/or magnitude continuously and/or regularly in order to minimize unwanted FSRU 100 and/or LNGC 800 movement and the damaging effects of sloshing.

Figure 11:
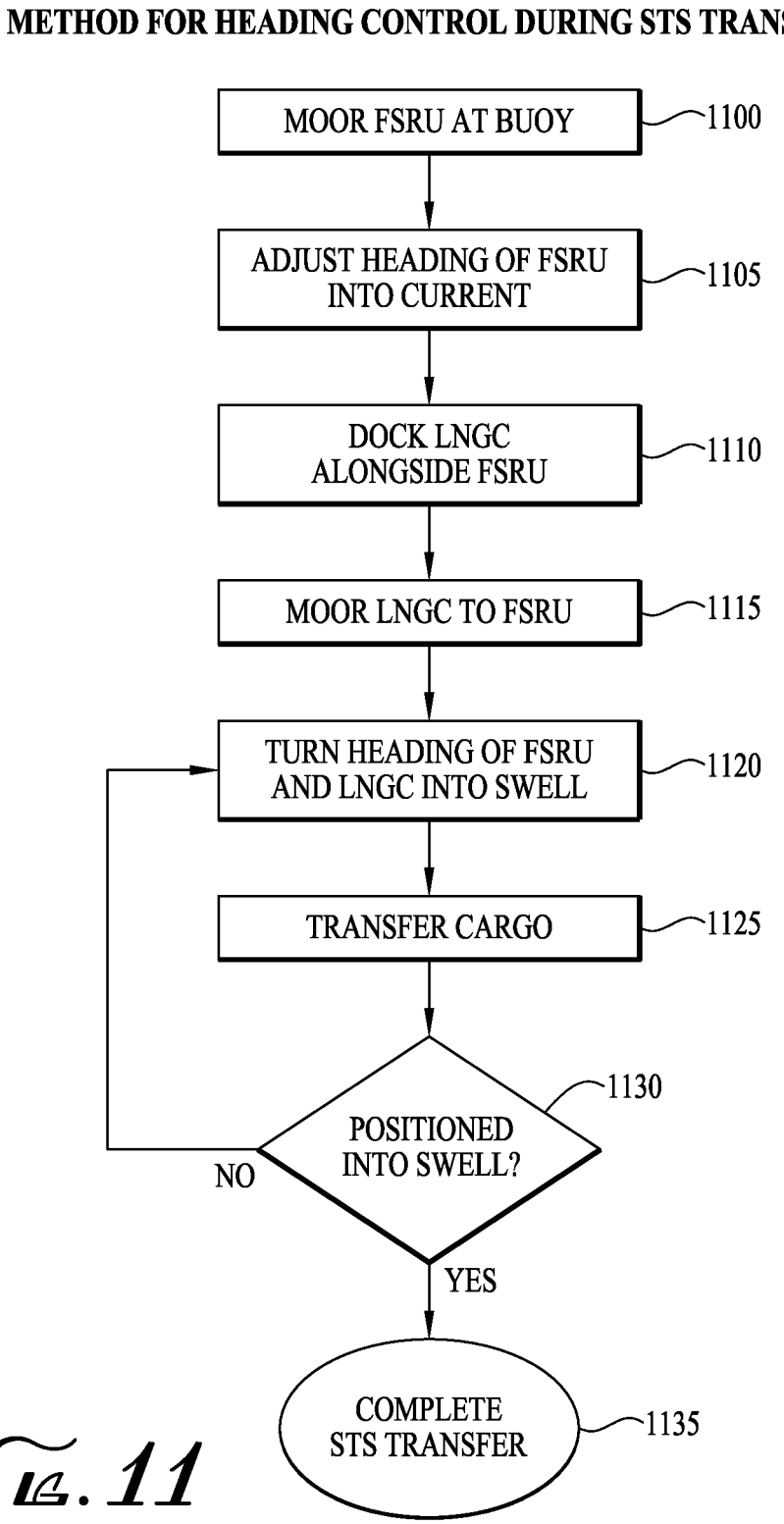
FIG. 11 is a flowchart diagram of a method for heading control of an FSRU and LNGC during ship-to-ship transfer between the vessels at a buoy.

FIG. 11 illustrates an exemplary method for heading control of an FSRU and/or LNGC during STS transfer operations. At mooring step 1100, FSRU 100 may be moored at buoy 105. At preparation step 1005, the heading of FSRU 100 may be adjusted to face bow 705 of FSRU 100 into current 830 using the heading control systems described herein, such as heading control lines 200 and/or thrusters 1000. LNGC 800 may then be docked alongside FSRU 100 in a double-bank configuration at docking step 1110, such that bow 805 of LNGC 800 also faces into current 830 and LNGC 800 is parallel to FSRU 100. At mooring step 1115, LNGC 800 may then be moored to FSRU 100, for example using connecting lines 205 proximate bow 705 of FSRU 100 and bow 805 of LNGC 800, and connecting lines 205 proximate stern 205 of FSRU 100 and stern 820 of LNGC 800, such that the heading of LNGC 800 will follow the heading of FSRU 100. At heading control step 1120, the heading of FSRU 100 may be turned into swell 835 and/or other predominant factor using the heading control systems of illustrative embodiments, such as heading control lines 200 and/or thrusters 1000. The heading of LNGC 800, moored to FSRU 100, may adjust and/or change along with FSRU 100 into swell 835 such that the risk due to sloshing in LNGC cargo tanks 840 is reduced and/or minimized and/or operating conditions of the STS transfer are optimized for safety. At heading control step 1120, the heading of FSRU 100 may be adjusted using thrusters 1000 and/or heading control lines 200. The heading of LNGC 800 may be pulled, pushed and/or adjusted as a result of connections 205 between FSRU 100 and LNGC 800, with LNGC 800 following the movement of FSRU 100. At transfer step 1125, LNG cargo may be transferred from LNGC 800 to FSRU 100. As LNG transfer progresses, the tanks 840 of LNGC 800 will become partially full (or partially empty) as LNG is transferred from LNGC 800 to FSRU 100. LNG transfer step 1125 may take several hours, such as 12 hours, 24 hours or 36 hours. During this time, the predominant factor, such as swell 835, may change, for example due to oceanic conditions and/or weather systems. At inquiry step 1130, an operator and/or computer may confirm at intervals such as every hour or every few hours whether or not FSRU 100 and LNGC 800 continue to be at a safe and/or optimal heading. If the vessels are not positioned into swell 835 at step 1130, then heading control step 1120 may be repeated, for example in the midst of the STS LNG transfer operations, in order to bring FSRU 100 and LNGC 800 to the desired heading. If FSRU 100 and LNGC 800 are at the desired heading at inquiry step 1130, the STS transfer operations may be completed at completion step 1135.

Once STS transfer between LNGC 800 and FSRU 100 is complete, LNGC 800 and FSRU 100 may disconnect and the LNGC 800 will depart. FSRU 100 may continue to deliver natural gas at the offloading port prior to, during and/or after STS transfer operations.

Illustrative embodiments may enable a FSRU to supply gaseous natural gas to a market through a turret buoy mooring that includes a connection to a subsea pipeline supplying users ashore, without the need for the FSRU to leave the buoy to replenish LNG cargoes. Illustrative embodiments may provide a method for safe mooring of a LNGC alongside the FSRU during transfer of LNG cargo between the two vessels and a method of minimizing sloshing to acceptable limits within the LNGC's cargo tanks when the LNGC is moored alongside the FSRU and/or when the LNGC is transferring LNG cargo to the FSRU. Illustrative embodiments may provide a system and method for fixing the heading of a FSRU moored to a turret buoy. The FSRU heading may be adjustable to change the fixed heading of the FSRU, for example in response to a change in a predominant factor. Adjusting the heading of the FSRU may optimize safety of mooring an LNGC alongside by minimizing unwanted movement of the vessels, which could otherwise result in hazardous conditions for the crew, increased likelihood of LNG leak or ignition, and/or damage to either vessel, such as by collision between the FSRU and LNGC and sloshing in the cargo tanks. Illustrative embodiments permit the FSRU heading control system to be quickly and safely released in the event that an emergency occurs which requires the FSRU to disconnect from the adjustable mooring arrangement.

A method and system for heading control during STS transfer of LNG has been described. Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

The invention claimed is:

1. A method for heading control during ship-to-ship (STS) transfer of liquefied natural gas (LNG) while moored on a buoy comprising:

berthing a FSRU to a buoy at a forward end of the FSRU;

holding a stern of the berthed FSRU at a first heading with a bow of the FSRU pointing into a current;

docking an LNG carrier (LNGC) alongside the berthed FSRU;

mooring the LNGC to the berthed FSRU in a double-banked configuration at the first heading;

adjusting the first heading of the FSRU and moored LNGC to a second heading, wherein the bow of the FSRU and a bow of the LNGC are pointing into a swell at the second heading, and wherein the swell has a direction; and transferring LNG from the LNGC to the FSRU while the FSRU and moored LNGC are pointed into the swell; and wherein adjusting a heading of the FSRU and moored LNGC comprises adjusting a length of at least two spread mooring lines to rotate a direction of a stern of the FSRU about the buoy, wherein the at least two spread mooring lines are coupled to the stern of the FSRU.

2. The method of claim 1, further comprising changing the second heading of the FSRU and moored LNGC to a third heading into a second swell having a second direction during the LNG transfer from the LNGC to the FSRU when the second swell develops and prevails in magnitude above the first swell.

3. The method of claim 1, wherein mooring the LNG to the berthed FSRU in a double-banked configuration comprises connecting the bow of the FSRU to the bow of the LNGC with a first connecting line and connecting a stern of the FSRU to a stern of the LNGC with a second connecting line.

4. The method of claim 1, wherein the buoy is a subsea turret buoy.

5. A system for heading control during ship-to-ship (STS) transfer of liquefied natural gas (LNG) to a floating storage regasification unit (FSRU) moored at a turret buoy comprising:

the FSRU moored in a water at the turret buoy;

an LNG carrier (LNGC) moored to the FSRU in a double-banked configuration such that a bow of the LNGC and a bow of the FSRU face same direction at a first heading of a plurality of headings, the LNGC comprising a manifold of a plurality of hoses fluidly coupling the LNGC to the FSRU;

the LNG flowing from the LNGC through at least one of the plurality of hoses to the FSRU; and at least two heading control lines coupled to a stern of the FSRU, wherein the at least two heading control lines are adjustable to turn both the FSRU and moored LNGC between the first heading and a selected heading of the plurality of headings.

6. The system of claim 5, wherein the selected heading holds the bow of the FSRU and the bow of the LNGC against a predominant factor, wherein the predominant factor is a resultant force of wind, swell, waves and current.

7. The system of claim 5, wherein the first heading faces the bow of the LNGC and the bow of the FSRU into a current of the water, and the selected heading faces the bow of the LNGC and the bow of the FSRU into a swell of the water.

8. The system of claim 5, wherein a first mooring line extends between the bow of the LNGC and the bow of the FSRU, and a second mooring line extends between the stern of the FSRU and a stern of the LNG.

9. The system of claim 5, wherein the turret buoy is submerged in the water, and a subsea riser fluidly couples the FSRU to a subsea gas pipeline.

10. A heading control method for ship-to-ship (STS) transfer of liquefied natural gas (LNG) while moored on a buoy comprising:

berthing a FSRU to the buoy at a forward end of the FSRU;

connecting at least two spread mooring lines to a stern of the berthed FSRU;

anchoring the stern of the berthed FSRU to a seabed using the at least two spread mooring lines such that a bow of the FSRU is held against a predominant factor;

calculating at intervals a resultant force of oceanic conditions and weather to determine the predominant factor at a particular time;

adjusting a length of the at least two spread mooring lines to rotate a direction of the stern of the FSRU about the buoy based on the predominant factor so calculated; and transferring LNG to the moored and anchored FSRU using STS transfer from a LNG carrier.

11. The method of claim 10, wherein there are three spread mooring lines comprising a port side line, a starboard side line and a center line between the port side line and the starboard side line, and adjusting the length of the at least two spread mooring lines comprises one of: retracting the starboard side line and the center line and extending the port side line, or retracting the port side line and the center line and extending the starboard side line.

12. The method of claim 10, wherein adjusting the length of one of the at least two spread mooring lines comprises using a storm line assembly to prepare for severe weather.

13. The method of claim 10, wherein the direction of the stern of the FSRU rotates between 10 degrees and 60 degrees about the buoy during adjustment.

14. The method of claim 10, wherein adjusting the length of the at least two spread mooring lines moderates sloshing of LNG cargo tanks of the LNG carrier.

15. The method of claim 10, wherein adjusting the length of the at least two spread mooring lines moderates motion of the FSRU and the LNG carrier.

16. A heading control system for ship-to-ship (STS) transfer of liquefied natural gas (LNG) to a floating unit moored at a turret buoy comprising:

the floating unit moored in a water at the turret buoy;

an LNG carrier (LNGC) moored to the floating unit in a double-banked configuration such that a bow of the LNGC and a bow of the floating unit face same direction at a first heading of a plurality of headings, the LNGC comprising a manifold of a plurality of hoses fluidly coupling the LNGC to the floating unit;

the LNG flowing from the LNGC through at least one of the plurality of hoses to the floating unit; and at least two stern heading control lines anchoring a stern of the floating unit to a seabed, each of the stern heading control lines comprising a winch, a guide, a line locking system and a release coupling; and wherein the at least two stern heading control lines are adjustable to turn both the floating unit and moored LNGC between the first heading and a selected heading of the plurality of headings.

17. The system of claim 16, wherein the selected heading holds the floating unit and the LNGC against a predominant factor, where the predominant factor is a resultant force acting upon the floating unit.

18. The system of claim 17, wherein the forces acting upon the floating unit are one of wind, waves, swell, current, or a combination thereof.

19. The system of claim 17, wherein the first heading is against a current and the predominant factor is swell.

20. The system of claim 16, wherein there are more than two stern mooring lines.

21. The system of claim 16, wherein the floating unit is a floating storage unit (FSU).

22. The system of claim 16, wherein the buoy is a turret external to the floating unit.

23. The system of claim 16, wherein the floating unit is a floating storage regasification unit (FSRU).

* * * * *